US011255550B2

(12) United States Patent
Morimoto et al.

(10) Patent No.: US 11,255,550 B2
(45) Date of Patent: Feb. 22, 2022

(54) HEATING AND HOT WATER SUPPLY DEVICE

(71) Applicant: NORITZ CORPORATION, Hyogo (JP)

(72) Inventors: Hiroshi Morimoto, Hyogo (JP); Naoki Tsuda, Hyogo (JP); Akihisa Kageyama, Hyogo (JP); Takehito Yokoyama, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 90 days.

(21) Appl. No.: 16/629,960

(22) PCT Filed: Jul. 13, 2018

(86) PCT No.: PCT/JP2018/026557
§ 371 (c)(1),
(2) Date: Jan. 10, 2020

(87) PCT Pub. No.: WO2019/021870
PCT Pub. Date: Jan. 31, 2019

(65) Prior Publication Data

US 2021/0080120 A1 Mar. 18, 2021

(30) Foreign Application Priority Data

Jul. 24, 2017 (JP) ..... JP2017-142602

(51) Int. Cl.
*F24D 3/08* (2006.01)
*F24H 1/52* (2006.01)

(52) U.S. Cl.
CPC ..... *F24D 3/08* (2013.01); *F24H 1/523* (2013.01)

(58) Field of Classification Search
CPC ..... F24D 3/08; F24H 1/523
See application file for complete search history.

(56) References Cited

U.S. PATENT DOCUMENTS 4,065,054 A * 12/1977 Meier ..... F24D 3/08 237/8 R
8,291,869 B2 * 10/2012 Min ..... F24H 9/0036 122/155.1

(Continued)

FOREIGN PATENT DOCUMENTS

GB 1543546 4/1979
JP S5815696 3/1983

(Continued)

OTHER PUBLICATIONS

Awane, JPH109596A English machine translation, Jan. 16, 1998 (Year: 1998).*

(Continued)

*Primary Examiner* — Edelmira Bosques
*Assistant Examiner* — Phillip Decker
(74) *Attorney, Agent, or Firm* — JCIPRNET

(57) ABSTRACT

Provided is a heating and hot water supply device. The heating and hot water supply device includes: a combustion part; a heat exchanger; a circulation passage; a circulation part; a bypass passage; a distribution means for distributing the heating medium to the circulation passage and the bypass passage; a hot water supply heat exchanger; a water supply passage; and a hot water supply passage (21). The distribution ratio of the distribution means is adjustable so as to correspond to a heating operation, a hot water supply operation, and the simultaneous heating and hot water supply operation. The heating and hot water supply device includes an operation part, which heats the heating medium to one or more heating terminal setting temperatures and circulates the heating medium, and switches a setting of the one or more heating terminal setting temperatures to be increased by a prescribed temperature during the simultaneous heating and hot water supply operation.

2 Claims, 2 Drawing Sheets

(56) References Cited

U.S. PATENT DOCUMENTS

| | | | | |
|---|---|---|---|---|
| 8,498,523 | B2 * | 7/2013 | Deivasigamani | F24D 17/0078 392/308 |
| 9,945,566 | B2 * | 4/2018 | Park | F24D 19/1069 |
| 2017/0363301 | A1 * | 12/2017 | Son | F24D 19/1051 |

FOREIGN PATENT DOCUMENTS

| | | | |
|---|---|---|---|
| JP | H04371750 | | 12/1992 |
| JP | 10-9596 | A * | 1/1998 |
| JP | 2005337632 | | 12/2005 |
| JP | 2006322655 | | 11/2006 |
| JP | 2011515647 | | 5/2011 |
| JP | 2014163590 | | 9/2014 |

OTHER PUBLICATIONS

"International Search Report (Form PCT/ISA/210) of PCT/JP2018/026557," dated Oct. 2, 2018, with English translation thereof, pp. 1-3.

* cited by examiner

HEATING AND HOT WATER SUPPLY DEVICE

CROSS-REFERENCE TO RELATED APPLICATION

This application is a 371 application of the international PCT application serial no. PCT/JP2018/026557, filed on Jul. 13, 2018, which claims the priority benefit of Japan application no. 2017-142602, filed on Jul. 24, 2017. The entirety of each of the above-mentioned patent applications is hereby incorporated by reference herein and made a part of this specification.

BACKGROUND OF THE INVENTION

Technical Field

The present invention relates to a heating and hot water supply device capable of performing a heating operation in which a heating medium heated by combustion heat is supplied to a heating terminal and a hot water supply operation in which tap water is heated by heat exchange with the heating medium to supply hot water, particularly relates to a heating and hot water supply device capable of simultaneously performing the heating operation and the hot water supply operation.

Related Art

Conventionally, a heating and hot water supply device capable of switchably performing a heating operation and a hot water supply operation is widely used. The heating and hot water supply device includes a combustion part, a heat exchanger, a circulation passage that connects the heat exchanger and a heating terminal installed in a room, a circulation pump arranged in the circulation passage, a bypass passage branched from the circulation passage and bypassing the heating terminal, and the like. A switch part that can be switched so that the heating medium flows through the circulation passage or the bypass passage is arranged in a branch portion between the circulation passage and the bypass passage. A hot water supply heat exchanger is arranged in the bypass passage, and a water supply passage for supplying tap water to the hot water supply heat exchanger and a hot water supply passage for supplying hot water from the hot water supply heat exchanger to a hot water supply plug or the like are respectively connected to the hot water supply heat exchanger.

The heating medium flowing due to the operation of the circulation pump is heated using the combustion heat of the combustion part in the heat exchanger. During the heating operation, in order to use the heated heating medium at the heating terminal, the switch part is switched so that the heating medium flows through the circulation passage. The heated heating medium flows through the circulation passage, dissipates heat at the heating terminal, and returns to the heat exchanger.

During the hot water supply operation, in order to use the heated heating medium in the hot water supply heat exchanger, the switch part is switched so that the heating medium flows through the bypass passage. The tap water supplied from the water supply passage is heated by heat exchange with the heating medium in the hot water supply heat exchanger. The heating medium that has exchanged heat with the tap water in the hot water supply heat exchanger returns to the heat exchanger. The hot water heated by the hot water supply heat exchanger is supplied from the hot water supply plug or the like through the hot water supply passage.

The heating and hot water supply device that switchably performs the heating operation and the hot water supply operation is inconvenient because the heating operation and the hot water supply operation cannot be performed simultaneously. Therefore, a heating and hot water supply device is known, which is capable of simultaneously performing the heating operation and the hot water supply operation by arranging a distribution part instead of the switch part and using the distribution part to distribute the heating medium for heating operation and hot water supply operation. In addition, as in patent literature 1, the heating operation and the hot water supply operation can also be performed simultaneously in a configuration in which a mixture part is arranged instead of the distribution part.

LITERATURE OF RELATED ART

Patent Literature

Patent literature 1: Japan Patent Publication No. 2011-515647

SUMMARY

Problems to be Solved

The heating and hot water supply device capable of simultaneous operation of the heating operation and the hot water supply operation (simultaneous heating and hot water supply operation) heats the heating medium to a preset temperature to perform the heating operation and the simultaneous heating and hot water supply operation. Because this temperature is set according to the temperature required by the heating terminal, even in the simultaneous heating and hot water supply operation with a large heating load, the temperature is limited to the setting temperature of the heating medium and there is room for heating capacity of the heating and hot water supply device in most cases. Particularly when the setting temperature of the heating medium required by the heating terminal is set low to prevent the risk of burns, maintain the durability of equipment or the like, an operation region in which simultaneous heating and hot water supply operation determined by the setting temperature of the heating medium and the setting temperature of the hot water supply becomes narrow, and the capacity of the heating and hot water supply device cannot be sufficiently exhibited.

An objective of the present invention is to provide a heating and hot water supply device which is capable of simultaneous heating and hot water supply operation and can be set to expand an operation region in which simultaneous heating and hot water supply operation is possible.

Means to Solve Problems

The invention of technical solution 1 is a heating and hot water supply device including: a combustion part, a heat exchanger that heats a heating medium by heat generated in the combustion part, a circulation passage that connects the heat exchanger and one or more external heating terminals, a circulation part arranged in the circulation passage to circulate the heating medium, a bypass passage branched from the circulation passage and bypassing the heating terminal, a distribution means for distributing the heating medium to the circulation passage and the bypass passage, a hot water supply heat exchanger arranged in the bypass passage, a water supply passage for supplying tap water to the hot water supply heat exchanger, and a hot water supply passage for supplying hot water heated by the hot water supply heat exchanger at a prescribed hot water supply set temperature. The distribution means is capable of adjusting the distribution ratio so as to correspond to a heating operation, a hot water supply operation, and a simultaneous heating and hot water supply operation. The heating and hot water supply device includes an operation part, which is configured to heat the heating medium to one or more heating terminal setting temperatures and to circulate the heating medium and to switch a setting of the one or more heating terminal setting temperatures to be increased by a prescribed temperature during the simultaneous heating and hot water supply operation.

According to the configuration, the operation part can carry out the setting so that the heating medium can be heated to a temperature that is higher by a prescribed temperature than the one or more heating terminal setting temperatures during the simultaneous heating and hot water supply operation. Accordingly, the amount of heat supplied via the heating medium during the simultaneous heating and hot water supply operation can be increased, and the operation region in which simultaneous heating and hot water supply operation is possible can be expanded.

The invention of technical solution 2 is the heating and hot water supply device of technical solution 1, in which the hot water supply passage includes a hot water supply bypass passage that bypasses the hot water supply heat exchanger, and a flow rate adjustment part for adjusting a flow rate of the hot water supply bypass passage; and the heating medium is heated to the one or more heating terminal setting temperatures and circulated during the hot water supply operation.

According to the configuration, since the tap water of the hot water supply bypass passage can be mixed with hot water heated to a temperature higher than the hot water supply setting temperature by heat exchange with the heating medium at the one or more heating terminal setting temperatures to be adjusted to the hot water supply set temperature, hot water supply at the hot water supply setting temperature can be performed. In addition, since the hot water supply operation is performed at the same temperature of the heating medium as in the heating operation, it is possible to quickly perform transitions among the heating operation, the hot water supply operation, and the simultaneous heating and hot water supply operation.

Effect

According to the heating and hot water supply device of the present invention, it is possible to expand an operation region in which simultaneous heating and hot water supply operation is possible.

DESCRIPTION OF THE EMBODIMENTS

Embodiments for implementing the present invention are described below based on examples.

EXAMPLE

Figure 1:
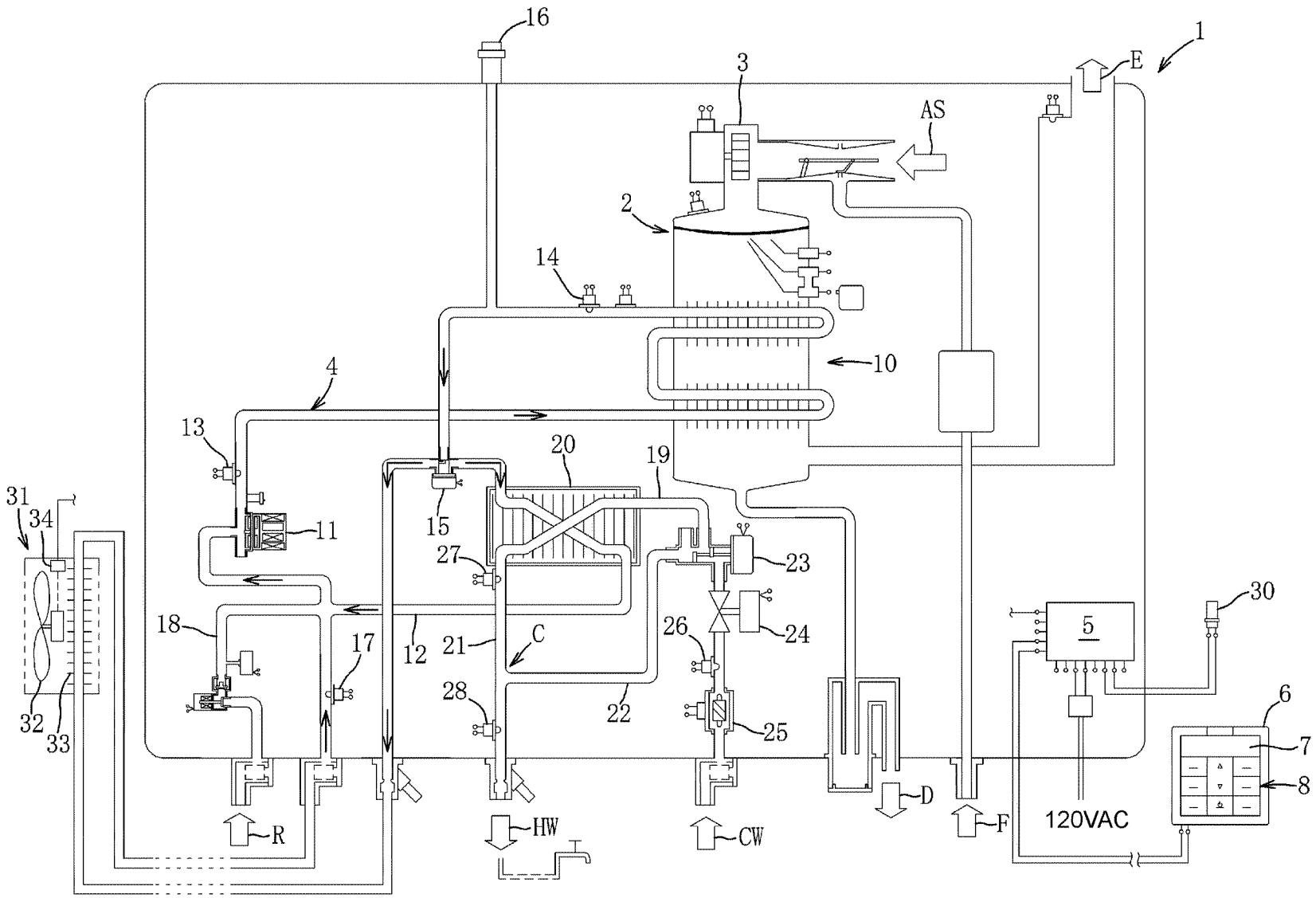
FIG. 1 is a diagram showing an overall configuration of a heating and hot water supply device of an embodiment of the present invention.

First, an overall configuration of a heating and hot water supply device 1 of the present invention is described with reference to FIG. 1.

The heating and hot water supply device 1 is configured to perform a heating operation in which a heating medium heated by using combustion heat of a combustion portion 2 is circulated between the heating and hot water supply device 1 and a heating terminal 31 installed outside the heating water heater 1, and a hot water supply operation in which tap water heated by using the heat of the heating medium is adjusted to a hot water supply setting temperature to supply hot water.

The heating and hot water supply device 1 includes the combustion portion 2 that is a combustion part, a heat exchanger 10, a circulation passage 4 that connects the heat exchanger 10 and the heating terminal 31, a circulation pump 11 that is a circulation part arranged closer to the upstream side of the circulation passage 4 than the heat exchanger 10, and the like. The combustion portion 2 includes a combustion blower 3, and burns, by the combustion blower 3, a gas mixture obtained by mixing and supplying supply air indicated by an arrow AS and a fuel gas indicated by an arrow F. The amount of the generated combustion gas and the amount of combustion heat are adjusted by controlling a rotation speed of the combustion blower 3. The heat exchanger 10 exchanges heat between the combustion gas generated by the combustion portion 2 and the heating medium, and heats the heating medium to a preset heating terminal set temperature. The combustion gas of which the temperature decreases due to the heat exchange is exhausted outside as indicated by an arrow E.

In addition, the heating and hot water supply device 1 includes a first bypass passage 12 (a bypass passage), a hot water supply heat exchanger 20 arranged in the first bypass passage 12, a water supply passage 19, a hot water supply passage 21, and the like. The first bypass passage 12 is branched from the circulation passage 4 on the downstream side of the heat exchanger 10 to bypass the heating terminal 31, and joins the circulation passage 4 on the upstream side of the circulation pump 11. The water supply passage 19 supplies tap water to the hot water supply heat exchanger 20 as indicated by an arrow CW. The hot water supply passage 21 supplies hot water heated by the hot water supply heat exchanger 20 to a hot water supply plug or the like as indicated by an arrow HW.

Furthermore, the heating and hot water supply device 1 includes a control portion 5 that controls the heating operation or the like. An operation terminal 6 for performing a setting operation or the like of the heating and hot water supply device 1 is communicably connected to the control portion 5 and is arranged, for example, in the room where heating is performed by the heating terminal 31. In addition, an outdoor temperature sensor 30 disposed outdoors is communicably connected to the control portion 5.

Next, the circulation passage 4 is described.

The circulation passage 4 includes a first temperature sensor 13 between the circulation pump 11 and the heat exchanger 10, and a second temperature sensor 14 on the downstream side of the heat exchanger 10. The first temperature sensor 13 detects the temperature of the heating medium flowing into the heat exchanger 10. The second temperature sensor 14 detects the temperature of the heating medium heated by the heat exchanger 10.

A first distribution valve 15 which is a distribution means is arranged in the branch portion between the circulation passage 4 and the first bypass passage 12. The first distribution valve 15 distributes the heating medium heated by the heat exchanger 10 to the circulation passage 4 and the first bypass passage 12 so as to correspond to the heating operation, the hot water supply operation, and the simultaneous heating and hot water supply operation, and the distribution ratio of first distribution valve 15 is adjustable. The heating medium distributed to the circulation passage 4 by the first distribution valve 15 is supplied to the heating terminal 31, and the heating medium distributed to the first bypass passage 12 is supplied to the hot water supply heat exchanger 20.

A pressure release valve 16 which releases the pressure in the circulation passage 4 is arranged between the heat exchanger 10 and the first distribution valve 15. A heating return temperature sensor 17 which detects the temperature of the heating medium returning from the heating terminal 31 is arranged on the upstream side of the circulation pump 11. A replenishment passage 18 for replenishing the heating medium as shown by an arrow R is connected between the circulation pump 11 and the heating return temperature sensor 17.

Next, the hot water supply heat exchanger 20 is described.

The hot water supply heat exchanger 20 is a plate-type heat exchanger, and passages are formed among a plurality of laminated heat exchange plates. In the hot water supply heat exchanger 20, the heating medium and the tap water supplied from the water supply passage 19 alternately flow through the passages among the heat exchange plates so as to face each other without being mixed with each other. On these heat exchange plates, irregularities are formed to expand the surface area and improve the heat exchange efficiency.

Next, the water supply passage 19 and the hot water supply passage 21 are described.

The water supply passage 19 includes a second distribution valve 23, a flow rate adjustment valve 24, a hot water supply flow rate sensor 25, and an entering water temperature sensor 26. By opening the hot water supply plug or the like, the tap water is supplied to the water supply passage 19 as indicated by the arrow CW. The second bypass passage 22 (the hot water supply bypass passage) is branched from the water supply passage 19, and the second distribution valve 23 arranged in the branch portion distributes the tap water to the water supply passage 19 and the second bypass passage 22, and the ratio of the second distribution valve 23 is adjustable. Accordingly, the second distribution valve 23 is a flow rate adjustment part which adjusts a flow rate of the tap water flowing through the second bypass passage 22. The flow rate adjustment valve 24 adjusts the flow rate of the tap water entering the second distribution valve 23. The hot water supply flow rate sensor 25 detects the flow rate of the tap water supplied to the second distribution valve 23. The entering water temperature sensor 26 detects the temperature of the tap water entering the second distribution valve 23.

The second bypass passage 22 joins the hot water supply passage 21 in a junction portion C. A hot water discharge temperature sensor 27 is arranged between the junction portion C and the hot water supply heat exchanger 20. The hot water discharge temperature sensor 27 detects the temperature of the hot water discharged from the hot water supply heat exchanger 20. A hot water supply temperature sensor 28 is arranged at the downstream end of the hot water supply passage 21. The hot water supply temperature sensor 28 detects the hot water supply temperature of the hot water obtained by mixing and supplying hot water heated by the hot water supply heat exchanger 20 and tap water flowing through the second bypass passage 22. In the hot water supply operation, the second distribution valve 23 is controlled so that the hot water supply temperature becomes the hot water supply set temperature.

Next, the control portion 5 is described.

The control portion 5 is connected to be capable of receiving a detection signal of the first temperature sensor 13 or the like arranged in the heating and hot water supply device 1 or receiving the rotation speed or the like of the combustion blower 3 or the like as a detection signal, and capable of setting a set value such as the rotation speed of the combustion blower 3 or the distribution ratio of the first distribution valve 15. Then, by controlling the combustion blower 3, the circulation pump 11, the first distribution valve 15 or the like based on the detection signal and the set value, each of the heating operation, the hot water supply operation, and the simultaneous heating and hot water supply operation is controlled.

For example, when there is a request for hot water supply operation during the heating operation, the control portion 5 determines whether the simultaneous heating and hot water supply operation is possible based on the detection signal, the set value, the heating capacity of the heating and hot water supply device 1, and the like. When it is determined that the simultaneous heating and hot water supply operation is possible, the simultaneous heating and hot water supply operation is performed, and when it is determined that the simultaneous heating and hot water supply operation is impossible, the heating operation is stopped and the hot water supply operation is performed.

Next, the operation terminal 6 is described.

Figure 2:
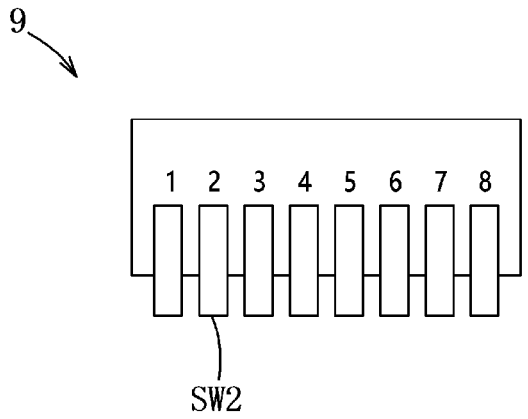
FIG. 2 is a diagram showing an example of an operation part.

The operation terminal 6 includes a display portion 7 capable of displaying, for example, temperature, operation status and the like, a switch portion 8 for performing a setting operation of the heating temperature or the hot water temperature or a start operation of the heating operation or the like, and a sound output portion that outputs a warning sound or the like, but the sound output portion is not shown. Furthermore, the operation terminal 6 includes a DIP switch 9 having a plurality of (for example, eight from #1 to #8) changeover switches for changing a setting or the like of the heating and hot water supply device 1 as shown in FIG. 2. Although not shown, the DIP switch 9 is arranged on a circuit board of the operation terminal 6, and is usually covered with, for example, a lid member or the like to prevent erroneous operation. The DIP switch 9 may also be arranged on a circuit board of the control portion 5.

The changeover switches of the DIP switch 9 are mainly operated during construction and maintenance of the heating and hot water supply device 1. As an operation part, for example, the #2 changeover switch SW2 (hereinafter referred to as a switch SW2) which is OFF in an initial state of FIG. 2 is turned ON, thereby switching to a setting at which the one or more heating terminal setting temperatures can be increased by a prescribed temperature (for example, 15° C.) during the simultaneous heating and hot water supply operation. The switch SW2 is an example of the operation part, and another changeover switch may be used as the operation part. The setting at which the one or more heating terminal setting temperatures can be increased by a prescribed temperature during the simultaneous heating and hot water supply operation can also be switched to by operation of the operation terminal 6 instead of or together with the switch SW2, and the prescribed temperature that can be increased can also be changed.

Next, the heating terminal 31 is described.

The heating terminal 31 includes, for example, a heating blower 32, a heating heat exchanger 33 for performing heat exchange between the heating medium and air, and a heating terminal control portion 34 that controls an air blowing operation or the like of the heating terminal 31, and performs heating by heating the introduced air with the heating heat exchanger 33 and blowing out warm air. A floor heating terminal having a heat transfer tube for transferring the heat of the heating medium to the floor of the room, a warm water heater that naturally convects air by the heat of the heating medium, or the like may also be connected as the heating terminal 31.

Since the required temperature of the heating medium may be different depending on the type of the heating terminal 31 and the like, the one or more heating terminal setting temperatures are set according to the heating terminal 31 during construction or the like for connecting the heating terminal 31 to the heating and hot water supply device 1. The one or more heating terminal setting temperatures are usually set to about 60° C.-80° C.

Next, the heating operation is described.

In the heating operation, in order to supply the heating medium heated to the one or more heating terminal setting temperatures to the heating terminal 31, the distribution ratio of the first distribution valve 15 is adjusted so that the heating medium flows through the circulation passage 4. The heating medium flows through the circulation passage 4 and dissipates heat at the heating terminal 31, and then returns to the heat exchanger 10.

Next, the hot water supply operation is described.

In the hot water supply operation, in order to supply the heating medium that is heated to a temperature higher than the hot water supply setting temperature by the heat exchanger 10 to the hot water supply heat exchanger 20 so that hot water supply at the hot water supply setting temperature is possible, the distribution ratio of the first distribution valve 15 is adjusted so that the heating medium flows through the bypass passage 12. For example, usually the hot water supply setting temperature is set to about 42° C., and when the one or more heating terminal setting temperatures are set to 60° C. which is higher than the heating terminal set temperature, the heating medium is also heated to the one or more heating terminal setting temperatures during the hot water supply operation.

On the other hand, during high-temperature hot water supply, the heating medium can be heated to a temperature higher than the one or more heating terminal setting temperatures and supplied to the hot water supply heat exchanger 20. For example, when the one or more heating terminal setting temperatures and the hot water supply setting temperature are both set to 60° C. and it is difficult to supply hot water at the hot water supply setting temperature by the heating medium at the heating terminal set temperature, the heating medium is heated to a temperature (for example, 70° C.) at which the high-temperature hot water supply at the hot water supply setting temperature is possible.

The heated heating medium exchanges heat with the tap water supplied from the water supply passage 19 by the hot water supply heat exchanger 20, and then returns to the heat exchanger 10. The hot water heated to a temperature higher than the hot water supply setting temperature by the hot water supply heat exchanger 20 is adjusted to the hot water supply setting temperature by mixing with the tap water of the second bypass passage 22 and is supplied to the hot water supply plug or the like in the hot water supply passage 21.

Next, the simultaneous heating and hot water supply operation is described.

When it is determined by the control portion 5 that the simultaneous heating and hot water supply operation is possible, the heating and hot water supply device 1 adjusts the distribution ratio of the first distribution valve 15 so that the hot water supply operation can be given priority to supply the hot water at the hot water supply set temperature. Then, based on the setting by the operation part, for example, the switch SW2, the heating medium is heated by the heat exchanger 10 to the one or more heating terminal setting temperatures or a temperature obtained by raising the one or more heating terminal setting temperatures by a prescribed temperature. The heated heating medium is distributed to the circulation passage 4 and the first bypass passage 12, and is supplied to the heating terminal 31 and the hot water supply heat exchanger 20. The tap water heated by the hot water supply heat exchanger 20 is adjusted to the hot water supply setting temperature and supplied to the hot water supply plug or the like in the hot water supply passage 21. The heating terminal 31 uses the heat of the heating medium to perform heating.

Next, the action and effect of the heating and hot water supply device 1 of the present invention is described with reference to FIG. 3.

Figure 3:
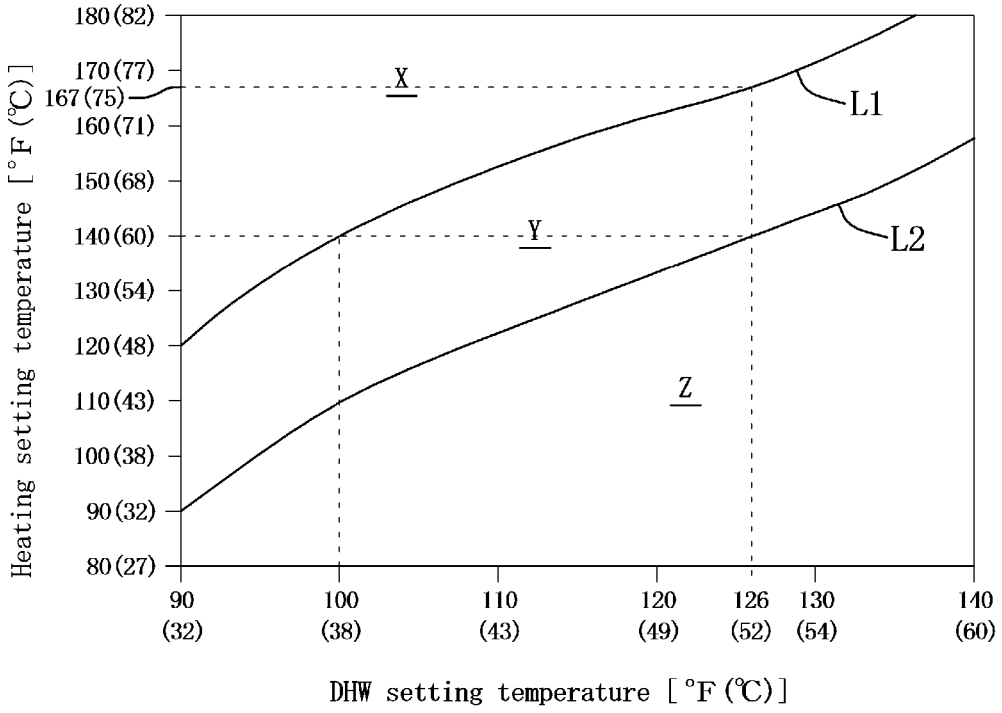
FIG. 3 is a diagram showing an example of an operation region in which simultaneous heating and hot water supply operation is possible.

FIG. 3 shows an operation region in which the simultaneous heating and hot water supply operation determined by the one or more heating terminal setting temperatures and the hot water supply setting temperature is possible and an operation region in which the simultaneous heating and hot water supply operation is impossible in the condition of a fixed hot water supply flow rate (for example, 8 L/min) and a fixed water supply temperature (for example, 4° C.), where the vertical axis is the one or more heating terminal setting temperatures and the horizontal axis is the hot water supply set temperature. When the operation part, for example, the switch SW2 is OFF, that is, in the case of a setting at which the one or more heating terminal setting temperatures are not raised by a prescribed temperature during the simultaneous heating and hot water supply operation, for example, when the one or more heating terminal setting temperatures are 60° C., the maximum hot water supply setting temperature at which the simultaneous heating and hot water supply operation is possible is 38° C. The relationship between the one or more heating terminal setting temperatures and the maximum hot water supply setting temperature at which the simultaneous heating and hot water supply operation is possible is represented by a curve L1, and an operation region X above the curve L1 indicates the operation region in which the simultaneous heating and hot water supply operation is possible.

On the other hand, when the operation part, for example, the switch SW2 is ON, that is, in the case of a setting at which the one or more heating terminal setting temperatures can be raised by a prescribed temperature (for example, 15° C.) during the simultaneous heating and hot water supply operation, the temperature of the heating medium can be raised by the prescribed temperature from the preset heating terminal setting temperature during the simultaneous heating and hot water supply operation. When the simultaneous heating and hot water supply operation is, based on the one or more heating terminal setting temperatures or the like, impossible at the preset heating terminal setting temperature but is possible if the temperature of the heating medium is increased within a prescribed temperature range, the control portion 5 increases the one or more heating terminal setting temperatures within the prescribed temperature range. Therefore, the amount of heat supplied to the heating terminal 31 and the hot water supply heat exchanger 20 by the heating medium increases. For example, when the one or more heating terminal setting temperatures are 60° C., the heating medium is heated to 75° C. at the maximum, and the maximum hot water supply setting temperature at which the simultaneous heating and hot water supply operation is possible is 52° C. The relationship between the one or more heating terminal setting temperatures and the maximum hot water supply setting temperature at which the simultaneous heating and hot water supply operation is possible is represented by a curve L2 in FIG. 3, and the operation region X and an operation region Y above the curve L2 indicate the operation regions in which the simultaneous heating and hot water supply operation is possible.

Accordingly, by operating the operation part such as the switch SW2 or the like and switching to the setting at which the one or more heating terminal setting temperatures can be raised by a prescribed temperature during the simultaneous heating and hot water supply operation, the operation region in which the simultaneous heating and hot water supply operation is possible can be expanded, and the capacity of the heating and hot water supply device 1 can be further exhibited. Besides, an operation region Z is an operation region in which the simultaneous heating and hot water supply operation is impossible regardless of operation of the operation part.

The normal hot water supply operation is performed by heating the heating medium to the heating terminal set temperature, and thus the tap water of the hot water supply bypass passage can be mixed with the hot water heated to a temperature higher than the hot water supply setting temperature by the hot water supply heat exchanger to be adjusted to the hot water supply set temperature, and hot water supply at the hot water supply setting temperature can be performed. In addition, since the hot water supply operation is performed at the same heating medium temperature as in the heating operation, a transition from the heating operation to the hot water supply operation and a transition from the hot water supply operation to the heating operation can be quickly performed when the control portion 5 determines that the simultaneous heating and hot water supply operation is impossible. Moreover, since the heating operation and the hot water supply operation are performed by heating the heating medium to the heating terminal set temperature, it is advantageous for risk prevention of burns and the like caused by the heating medium at a temperature higher than the one or more heating terminal setting temperatures or prevention of malfunction occurrence of the heating terminal 31.

In addition, those skilled in the art can implement the present invention in aspects where various modifications are applied to the above embodiment without departing from the gist of the present invention, and the present invention includes the modification aspects.

What is claimed is:

1. A heating and hot water supply device, comprising:

a combustion part comprising a combustion blower, a heat exchanger that heats a heating medium with heat generated by the combustion part, a circulation passage that connects the heat exchanger and one or more external heating terminals, a circulation pump arranged in the circulation passage to circulate the heating medium, a bypass passage branched from the circulation passage and bypassing the heating terminal, a distribution valve for distributing the heating medium to the circulation passage and the bypass passage, a hot water supply heat exchanger arranged in the bypass passage, a water supply passage that supplies tap water to the hot water supply heat exchanger, and a hot water supply passage for supplying hot water heated by the hot water supply heat exchanger at a prescribed hot water supply set temperature;

wherein a distribution ratio of the distribution valve is adjustable so as to correspond to a heating operation, a hot water supply operation, and a simultaneous heating and hot water supply operation, and the heating and hot water supply device comprises a changeover switch, which is configured to heat the heating medium to one or more heating terminal setting temperatures and to circulate the heating medium, and to switch a setting of the one or more heating terminal setting temperatures to be raised by a prescribed temperature during the simultaneous heating and hot water supply operation.

2. The heating and hot water supply device according to claim 1, wherein the hot water supply passage comprises:

a hot water supply bypass passage that bypasses the hot water supply heat exchanger, and a flow rate adjustment valve for adjusting a flow rate of the hot water supply bypass passage; and the heating medium is heated to the one or more heating terminal setting temperatures and circulated during the hot water supply operation.

* * * * *